US007104830B1

(12) United States Patent
Diaz

(10) Patent No.: US 7,104,830 B1
(45) Date of Patent: Sep. 12, 2006

(54) ELECTRICAL CONNECTIONS HAVING PULLOUT PREVENTION FEATURE

(76) Inventor: Jose Diaz, 123 Hidden Court Rd., Hollywood, FL (US) 33023

( * ) Notice: Subject to any disclaimer, the term of this patent is extended or adjusted under 35 U.S.C. 154(b) by 0 days.

(21) Appl. No.: 11/201,953

(22) Filed: Aug. 12, 2005

(51) Int. Cl.
*H01R 13/62* (2006.01)

(52) U.S. Cl. ..... 439/372; 439/347

(58) Field of Classification Search ..... 439/345, 439/347, 372, 373, 376
See application file for complete search history.

(56) References Cited

U.S. PATENT DOCUMENTS 2,399,644 A * 5/1946 Lachance ..... 439/362
4,861,276 A * 8/1989 Muller et al. ..... 439/365
6,676,435 B1 * 1/2004 Momiyama ..... 439/372
6,780,031 B1 * 8/2004 Valls ..... 439/147
6,878,005 B1 * 4/2005 Varone et al. ..... 439/347

* cited by examiner

*Primary Examiner*—James R. Harvey

(57) ABSTRACT

An electrical connection that is equipped with a pullout prevention clip which can be advantageously used to prevent an electrical plug from being accidentally removed from the connection. The electrical connection includes a socket member formed recessed in an electronic device for receiving a plug, the plug is molded with a groove in an outer peripheral surface, a shaft member attached to the electronic device for anchoring a clip member and acting as an axis pivotally or slidingly engages the clip member, the clip member has a cutout portion for engaging the groove in the plug upon deployment and thereby preventing the plug from being accidentally or unintentionally pulled out.

4 Claims, 4 Drawing Sheets

ELECTRICAL CONNECTIONS HAVING PULLOUT PREVENTION FEATURE

The present invention generally relates to a secured method for making electrical connections between a plug and a socket and more particularly, provides an electrical connection that has pullout prevention feature for preventing an electrical plug from accidentally being disconnected from the electrical socket.

BACKGROUND OF THE INVENTION

A majority of computer equipment or other electronic equipment that requires electrical connection to a power source or to other peripheral equipment are provided with a recessed electrical connector in the back panel of the equipment. An electrical plug, of either the female type or the male type, is then plugged into the electrical connector for providing power or other accessory communications to the accessories. For instance, in the case of a computer, other peripheral equipment such as printer, scanner, display panel must be electrically connected to the base unit of the computer. This type of electrical connection is normally provided by plugging a plastic molded plug into a recessed connector that is provided on the back of equipment. This type of electrical connection can be easily disconnected, even when it is unintended. When a user moves the equipment slightly, when someone trips over the electrical cord and when the equipment is transported to another location, the plug in the back of the equipment can be easily disconnected or unplugged accidentally. When such disconnection occurs during the operation of the computer, major data loss can occur which can cause severe problems for the user.

While some manufactures provide electrical connectors that are equipped with screws on the side of the plug, such connection to the back of an equipment or the disconnection from the back of any equipment can be tedious and time consuming since all the screws must be disconnected first before the plug can be removed. Furthermore, during the connection phase, it is also time consuming since the screws must be threaded into screw holes in the back of the computer.

It is therefore an object of the present invention to provide an electrical connection that cannot be accidentally disconnected from the back of an electronic equipment.

It is another object of the present invention to provide an electrical connection that has pullout prevention feature.

It is still another object of the present invention to provide an electrical connection that is equipped with a clip member for securing a female or male plug on its outer surface.

It is yet another object of the present invention to provide an electrical connection by using a clip member to either pivotally or slidingly engaging an electrical plug on its outer surface.

SUMMARY OF THE INVENTION

In accordance with the present invention, an electrical connection that has pullout prevention feature such that any electrical plug cannot be accidentally unplugged is provided.

In a preferred embodiment, the present invention electrical connection equipped with a pullout prevention clip member is provided which includes a socket formed recessed in a planner surface for providing electrical communication with a plug, the plug is molded with a groove in a peripheral surface; and a shaft member attached to the planner surface juxtaposed to the socket for anchoring a clip member and acting as an axis pivotally or slidingly engaging the clip member, the clip member has a cutout therein for engaging the groove in the plug upon deployment and thereby preventing the plug from being pulled out unintentionally.

DETAILED DESCRIPTION OF THE PREFERRED AND ALTERNATE EMBODIMENTS

The present invention discloses an electrical connection that has a built in pullout prevention feature such that an electrical plug cannot be accidentally, unintentionally removed from a socket.

The present invention electrical connection can be built into many types of consumer electronics, PC related, or notebook related device to secure the connection of any power cord, input cord, or output cord. There are two alternate embodiments of the present invention, i.e. a pivoting type and a sliding type. Two illustrating examples for the pivoting type electrical connection will be shown, while one illustrating example for the sliding type electrical connection will be shown. The present invention pullout prevention feature can be equally applicable to any type of electrical connections, i.e. either a male plug or a female plug, either a three-prong type or a two-prong type.

In the pivoting embodiment, a locking post is further provided on the planar surface of the equipment for locking onto the clip member. The clip member can be attached to the planar surface of the electronic device through a swivel connection to allow the clip member to be operated pivotally.

Figure 1:
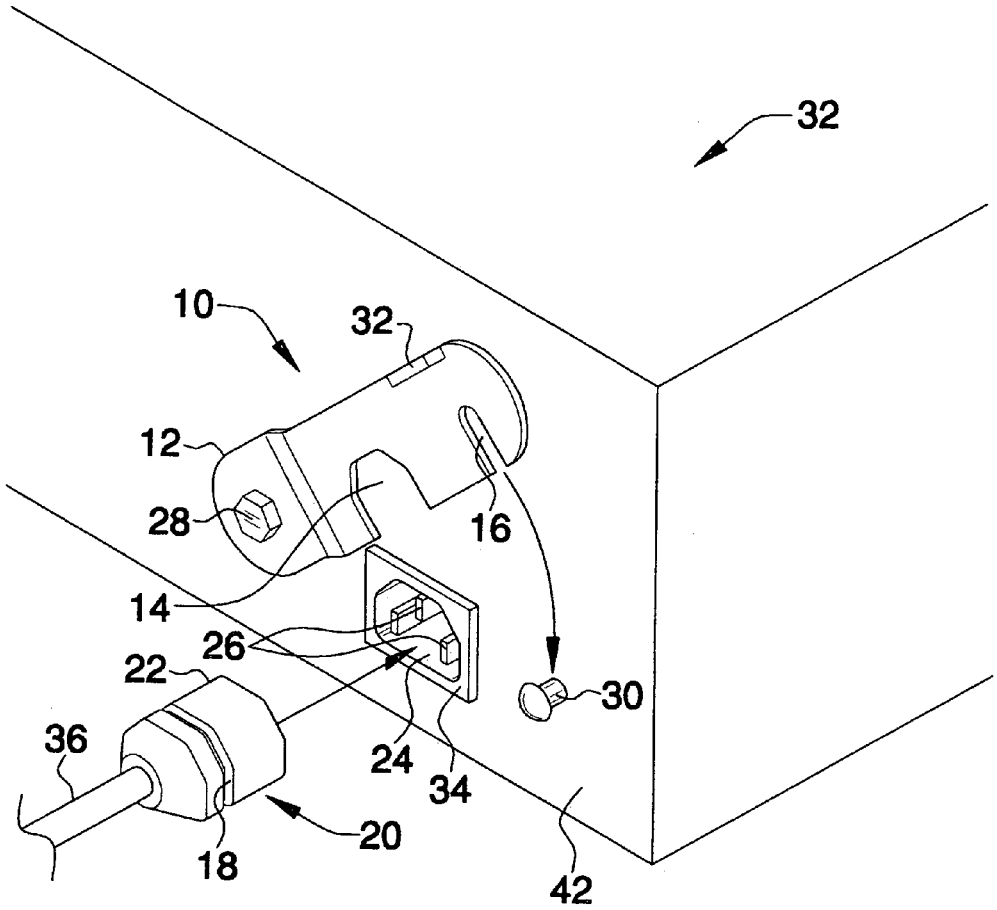
FIG. 1 is a perspective view illustrating the present invention electrical connection that is equipped with a pullout prevention clip that operates pivotally.

Referring initially to FIG. 1, wherein a perspective view of the pivotal type clip member for the present invention electrical connection is shown. The clip member 10 is formed of an elongated body 12 of either metal or plastic. The elongated body 12 can be formed in a planar piece with two cutouts 14 and 16. The first cutout 14 is used to engage a groove 18 provided on a female plug 20. When the female plug 20 is formed of molded plastic, the groove 18 can be easily molded in an outer peripheral surface 22 of the plug 20. The female plug 20 is inserted into socket 24 which has protruding male prongs 26. When the plug 20 is fully inserted into socket 24, the clip member 10 is pivoted downwardly, or in a clockwise direction, around the swivel screw 28 such that cutout 14 engages the groove 18 on the plug 20 to prevent the plug 20 from being accidentally pulled out. The second cutout 16 in the clip number 10 engages the locking post 30 when the clip member 10 is in an engaged position to further secure the locking action of the clip number 10 on the plug 20. The electronic device 32 may be a notebook computer, a desktop PC, or any other electronic devices. The clip member 10 is further provided with a lift tab 32 located at a top edge of the clip member for easy lifting, or unlocking of the clip member 10 from the plug 20. The lift tab 32 may be integrally formed with the elongated body 12 by press forming or molding.

Figure 2:
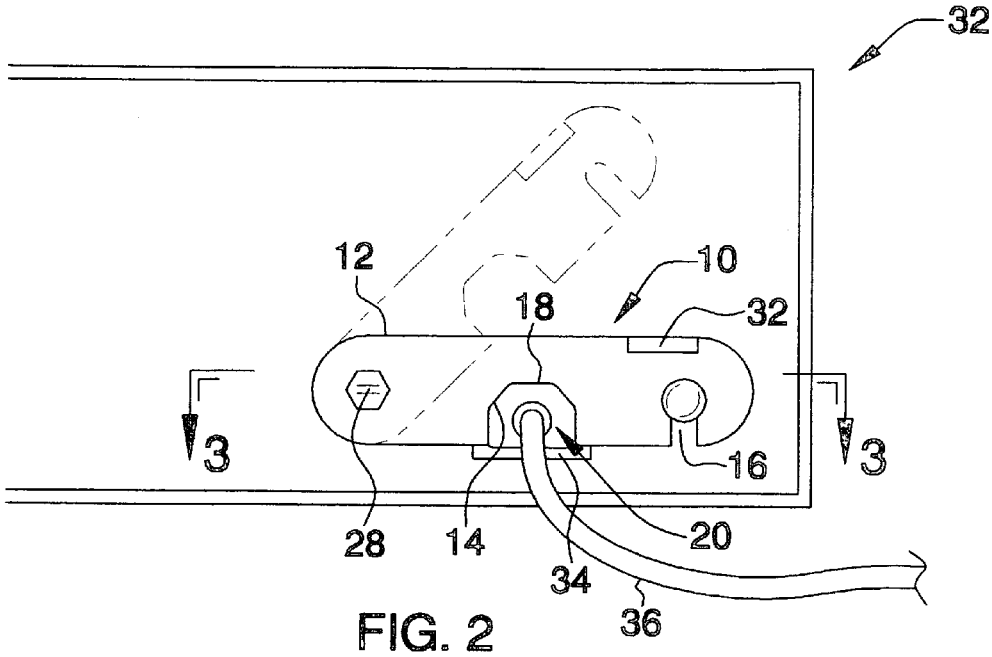
FIG. 2 is a plane view of the present invention electrical connection equipped with a pullout prevention clip that operates pivotally.

FIG. 2 is a plane view of the present invention electrical connection by using the clip member 10 shown in FIG. 1. A bottom edge of the outer frame 34 is shown while the remainder of the frame is covered by the plug 20 and the clip member 10. The wire 36 provides electrical power or other signal source to the electronic device 32.

Figure 3:
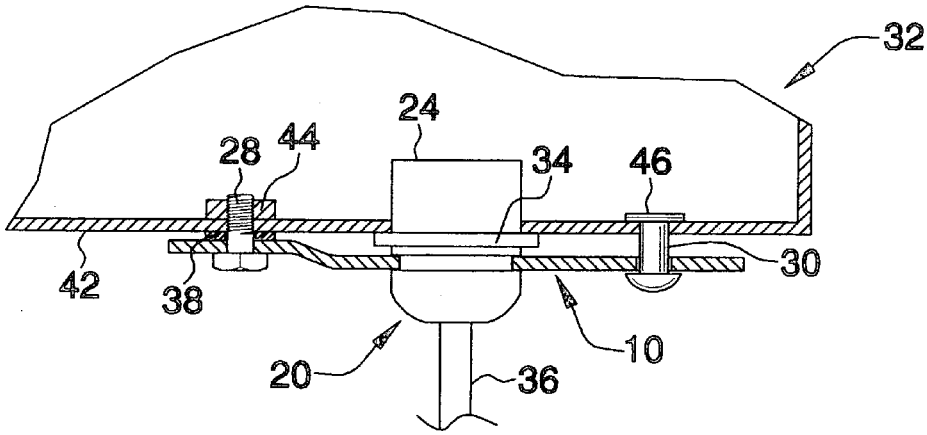
FIG. 3 is a partial, cross sectional view illustrating the present invention electrical connection with a clip member in an engaged position.

The partial, cross-sectional view of the present invention electrical connection with the clip member 10 is shown in FIG. 3. It should be noted that a plastic spacer 38 is utilized to provide smooth operation of the clip member 10 when pivoting against the swivel screw 28. The plastic spacer 38 can be made of any suitable plastic material that has good lubricating characteristics. FIG. 3 also shows that the swivel screw 28 is locked onto the back panel 42 of the electronic device 32 by a locking nut 44. Similarly, the locking post 30 is locked onto the back panel 42 by a locking nut 46.

Figure 4:
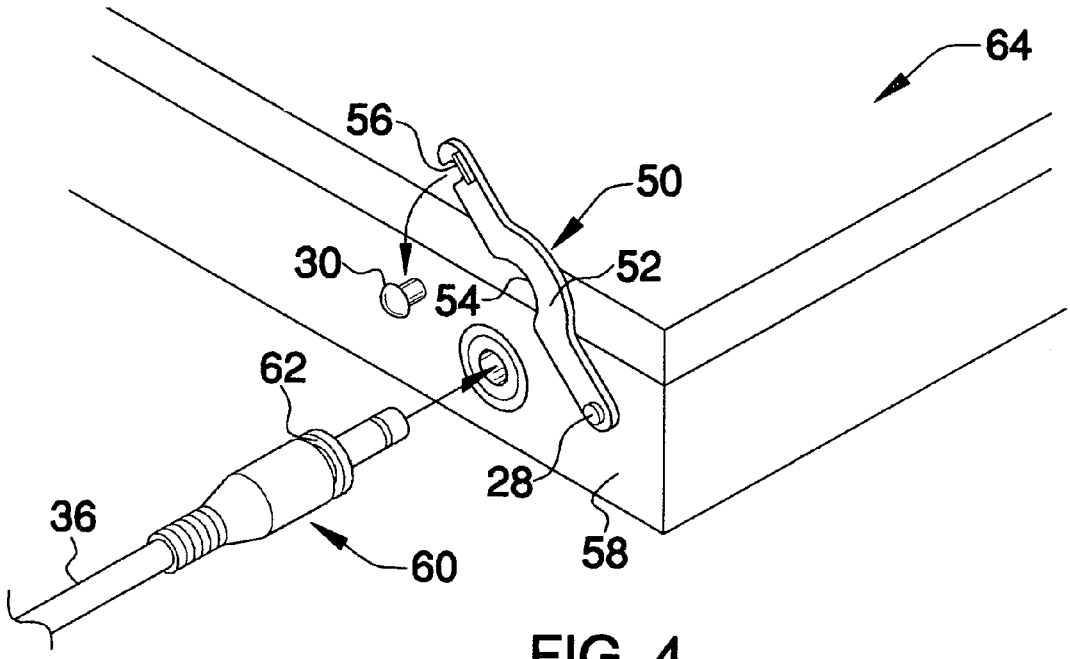
FIG. 4 is a second embodiment of the present invention electrical connection that operates pivotally.
Figure 5:
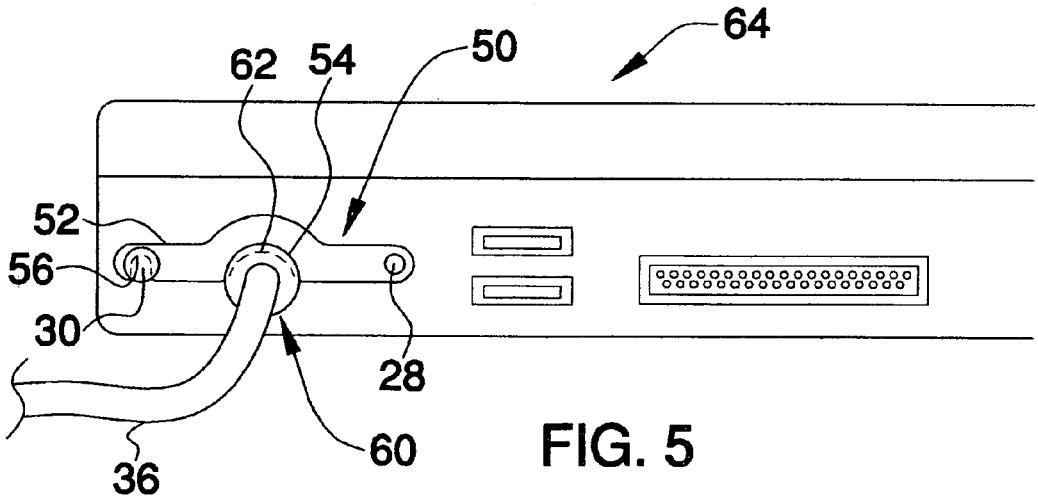
FIG. 5 is a plane view of the second embodiment shown in FIG. 4 with the clip member in an engaged position.

A second embodiment of the present invention electrical connection system utilizing a pivoting type clip member 50 is shown in FIGS. 4 and 5, in a perspective view and in a plane view, respectively. The clip member 50, as shown in FIG. 4, has a curved, elongated body 52 that is designed in a more streamlined fashion than the clip member 10 for engaging a smaller plug 60 which is a power adaptor. The groove 62 provided on the plug 60 is engaged by the cutout 54 on the clip member 50. The second cutout 56 is used to engage the locking post 30 also mounted on the back panel 58 of the electronic device 64. The electronic device 64 may be suitably a notebook computer that utilizes a dc power from a power adaptor that is equipped with plug 60.

Figure 6:
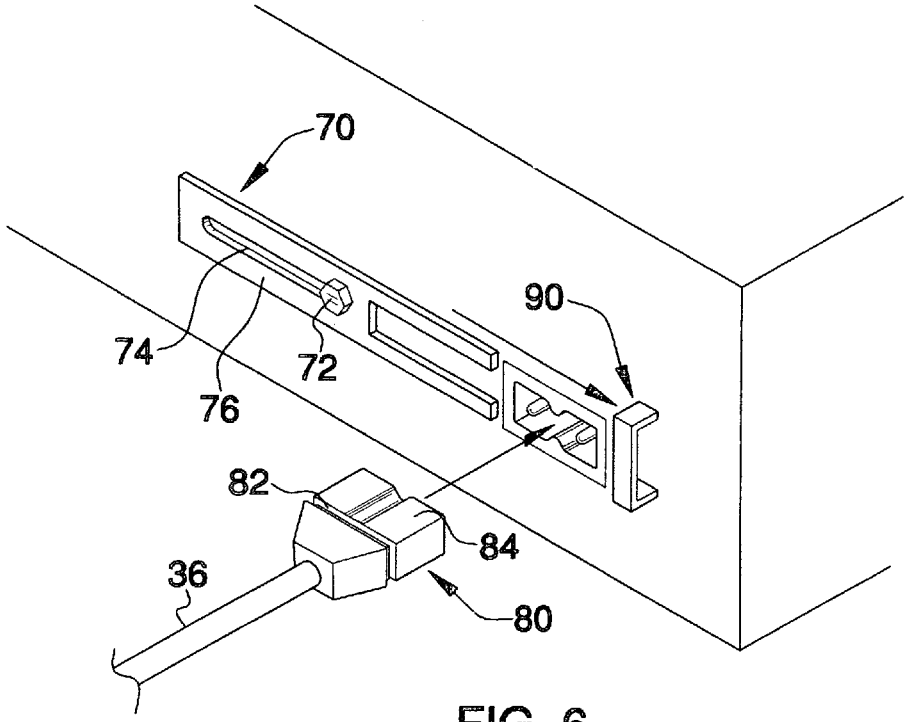
FIG. 6 is a third embodiment of the present invention electrical connection with the clip member that operates slidingly.
Figure 7:
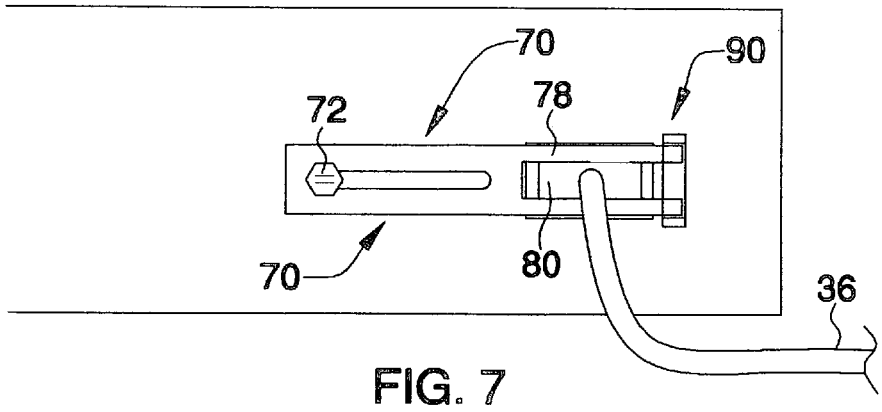
FIG. 7 is a plane view of the third embodiment of the present invention with the clip member in an engaged position.

A third alternate embodiment of the present invention electrical connection equipped with a sliding type clip member 70 is shown in FIGS. 6 and 7, in a perspective view and in a plane view, respectively. The clip member 70 slides on the mut 72 in a slot opening 74 provided in the elongated body 76 of the clip member 70. The locking member 70 is further provided with a cutout, or locking prongs 78 for engaging groove 82 formed on the plug 80. The groove 82 is formed similar to the previous plugs 20 and 60, in a peripheral surface 84 of the plug 80. The locking prongs 78 are moved toward the right until locked by a locking bracket 90, as shown in FIG. 6. A sliding motion of the clip member 70 is used to lock the plug 80 instead of a pivoting motion shown in the previous embodiments.

We claim:

1. An electrical connection equipped with a pullout prevention clip comprising;

a socket formed recessed in a planar surface for providing electrical communication with a plug, said plug being molded with a groove in an outer peripheral surface; and shaft member attached to said planar surface juxtaposed to the socket for anchoring a clip member and acting as an axis slidingly engages said clip member;

said clip member having a cutout portion therein for engaging said groove in said plug upon deployment and is equipped with locking prongs engaging a locking bracket in a linear sliding motion preventing said plug from being pulled out unintentionally.

2. The electrical connection equipped with a pullout prevention clip according to claim 1, wherein said clip member having an elongated body and at least one cut out for engaging the groove on a plug.

3. The electrical connection equipped with a pullout prevention clip according to claim 2, wherein said groove is formed in an outer peripheral surface of the plug member.

4. The electrical connection equipped with a pullout prevention clip according to claim 1, wherein said clip member is formed of metal or plastic.

* * * * *